US007406744B2

(12) United States Patent
Bruneau

(10) Patent No.: US 7,406,744 B2
(45) Date of Patent: Aug. 5, 2008

(54) CENTRAL VACUUM SYSTEM WITH SECONDARY AIRFLOW PATH

(76) Inventor: Marc Bruneau, 468 de la Pommeraie, Rosemere, Quebec (CA) J7A 4N3

( * ) Notice: Subject to any disclaimer, the term of this patent is extended or adjusted under 35 U.S.C. 154(b) by 727 days.

(21) Appl. No.: 11/039,202

(22) Filed: Jan. 20, 2005

(65) Prior Publication Data

US 2006/0156504 A1 Jul. 20, 2006

(51) Int. Cl.
*A47L 5/38* (2006.01)
*A47L 9/22* (2006.01)

(52) U.S. Cl. ..... 15/413; 15/301

(58) Field of Classification Search ..... 15/413, 15/301

See application file for complete search history.

(56) References Cited

U.S. PATENT DOCUMENTS 3,173,164 A 3/1965 Congdon
4,052,765 A * 10/1977 Guhne et al. ..... 15/344
4,120,616 A * 10/1978 Dwyer et al. ..... 417/373
4,330,899 A * 5/1982 Miller et al. ..... 15/326
4,399,378 A 8/1983 Krumm et al.
4,665,581 A * 5/1987 Oberdorfer ..... 15/326
5,353,469 A * 10/1994 Fellhauer ..... 15/326
5,369,839 A * 12/1994 Worwag ..... 15/327.6
5,400,463 A * 3/1995 Attard et al. ..... 15/326
5,412,837 A 5/1995 Worwag
5,685,894 A 11/1997 Bowerman et al.
5,690,713 A 11/1997 Bowerman et al.
5,725,623 A 3/1998 Bowerman et al.
5,737,797 A 4/1998 Rittmueller et al.
5,813,085 A * 9/1998 Fritz et al. ..... 15/314
6,003,200 A * 12/1999 Potts et al. ..... 15/413
6,289,553 B1 9/2001 Dyson
6,481,050 B1 11/2002 Wilson et al.
6,779,228 B2 * 8/2004 Plomteux et al. ..... 15/326
2002/0178531 A1 12/2002 Plomteux et al.

FOREIGN PATENT DOCUMENTS

WO WO 02/069778 A1 9/2002

* cited by examiner

*Primary Examiner*—David B Thomas
(74) *Attorney, Agent, or Firm*—Robert J. Harter

(57) ABSTRACT

A central vacuum system includes a motor-cooling airflow path that provides sufficient cooling for the motor and its drive components even though the cooling air is partially restricted by a downstream filter that captures airborne carbon dust emitted from the motor's commutator brushes. A divider system creates multiple chambers within the vacuum system's canister, and in some embodiments, air passageways in the canister and in the divider system direct the cooling air through the chambers in a flow pattern that avoids contaminating the drive components with carbon dust.

17 Claims, 5 Drawing Sheets

CENTRAL VACUUM SYSTEM WITH SECONDARY AIRFLOW PATH

BACKGROUND OF THE INVENTION

1. Field of the Invention

The subject invention generally pertains to central vacuum systems and more particularly to a motor-cooling airflow path for such a system.

2. Description of Related Art

Typical central vacuum systems comprise a blower or vacuum motor that creates a vacuum within a stationary canister. A network of tubing usually connects the canister to several wall-mounted inlet ports that are installed at various locations throughout a house or building. A flexible hose can connect a portable vacuum tool to any of the inlet ports, so the tool can be used for vacuuming a floor or other surface. The vacuum motor draws dust-laden air in series through the tool, through the hose, through the tubing network and into the canister where the dust collects. The canister can be manually opened to empty it periodically.

There are two main types of central vacuum system: cyclonic and filtered. With a cyclonic system, structure within the canister directs the dust-laden air to circulate in a vortex, which employs centrifugal force to help separate the heavier dust particles from the air. A chute directs the separated dust particles to the bottom of the canister where they accumulate for later disposal. The vacuum motor draws the lighter clean air out from within the center of the vortex and discharges the air to atmosphere. Some cyclonic vacuum systems also include a filter.

In comparison, a filtered system includes a main filter instead of the vortex-generating structure. The filter blocks the dust particles while allowing clean air to be discharged to atmosphere. If the filter is in the form of a bag, the dust collects in the bag. Otherwise, the dust may simply drop from the filter onto the bottom of the canister for later disposal.

Many vacuum cleaners direct air across its motor to help cool the motor. The cooling air, unfortunately, may entrain carbon dust from the motor's commutator brushes and deposit a carbon residue on the exterior of the machine. To avoid this problem, some vacuum cleaners have a separate filter to help keep the carbon dust inside the machine. Examples of vacuum cleaners with a filter for carbon dust are disclosed in U.S. Pat. Nos. 5,685,894 and 5,412,837. Although such filters help keep the machine clean, they also create an airflow restriction that may lead to overheating.

Consequently, there is a need for a vacuum cleaner having a cooling airflow pattern that is suitable for use with a carbon dust filter.

SUMMARY OF THE INVENTION

One object of some embodiments of the invention is to provide a central vacuum system with a filter for catching carbon dust released from the vacuum motor's commutator brushes.

Another object of some embodiments is to cool one or more of the motor's electrical drive components (e.g., a triac) with air that has not first been preheated by the motor.

Another object of some embodiments is to help prevent carbon dust from a motor's commutator brushes from contaminating a motor drive component or its associated circuit board.

Another object of some embodiments is to install a vacuum motor and its electrical drive components in two separate compartments within a tubular canister of a central vacuum system.

Another object of some embodiments is to cool a vacuum motor with a greater volume of air than that used for cooling the motor's electrical drive components.

Another object of some embodiments is to provide a central vacuum system with a filter for carbon dust without having to install the motor's drive components on the exterior of the vacuum canister.

Another object of some embodiments is to mount air-cooled electrical components within a vacuum canister and still provide a removable cover at the top of the canister for accessing the motor and other interior components.

Another object of some embodiments is to cool a vacuum motor's drive components with a relatively cool, low volume of air, and to cool the motor itself with warmer air but at a higher volume.

Another object of some embodiments is to provide a vacuum canister with a plenum for mixing ambient air with air that has been preheated by the motor's electrical drive components.

Another object of some embodiments is to maintain the absolute air pressure of various chambers within a vacuum canister to achieve a desired airflow pattern for cooling a motor and its electrical drive components.

Another object of some embodiments is to position a motor chamber and an electrical chamber between an upper plenum and a lower suction chamber to facilitate the assembly, repair and operation of a central vacuum system.

Another object of some embodiments is to install a motor's electrical components inside a central vacuum canister with the cylindrical sidewall of the canister supporting the weight of the components, thereby eliminating the need for an exterior mounted electrical box.

One or more of these and/or other objects of the invention are provided by a central vacuum canister that includes a motor-cooling airflow pattern that can accommodate a filter for catching carbon dust released from the motor's commutator brushes.

DESCRIPTION OF THE PREFERRED EMBODIMENT

Figure 1:
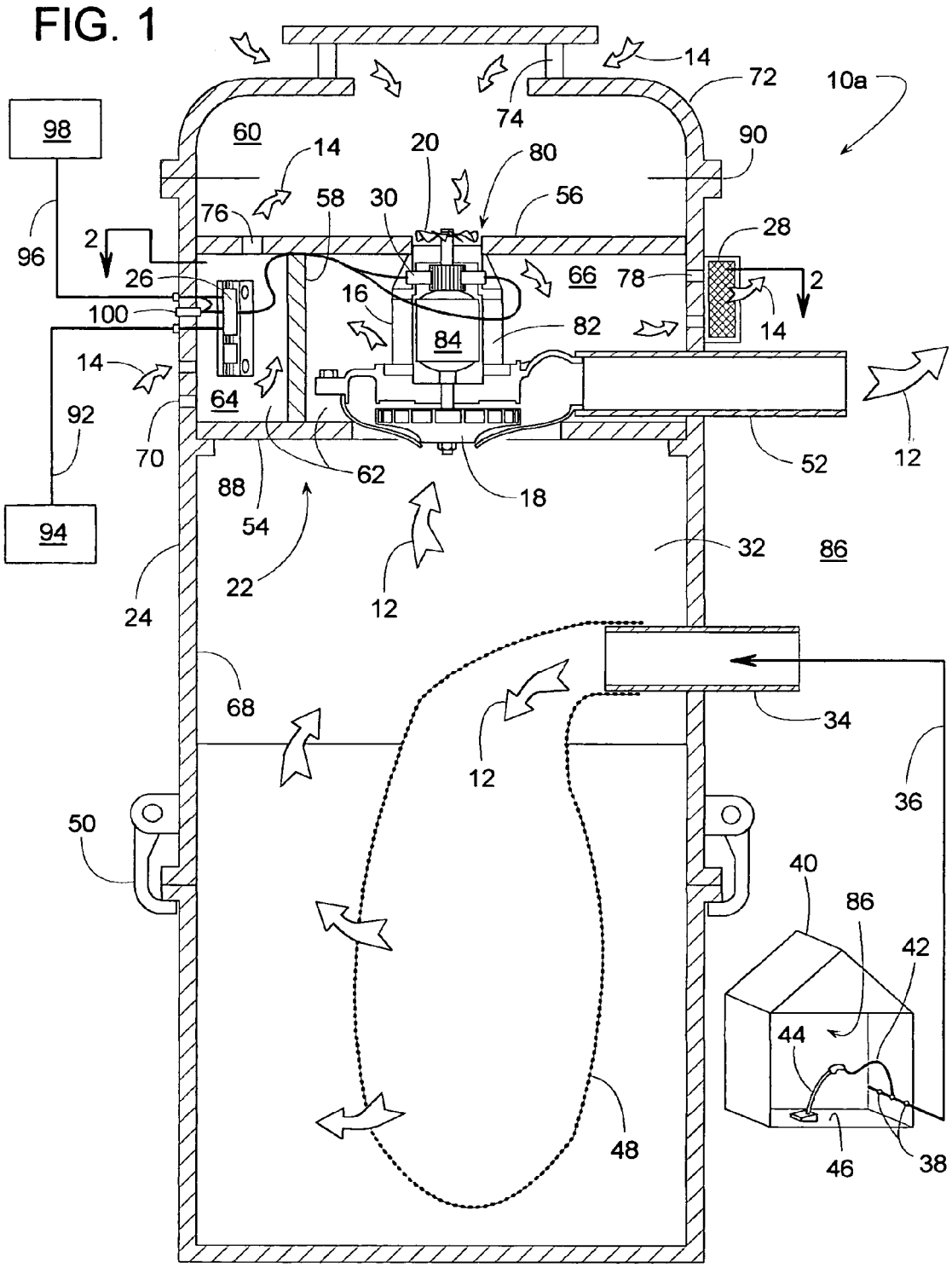
FIG. 1 is a cross-sectional side view of a vacuum canister and a schematic illustration of the remainder of a central vacuum system, wherein the canister includes a filter for capturing carbon dust from a current of air that cools the motor and its electrical drive components.
Figure 2:
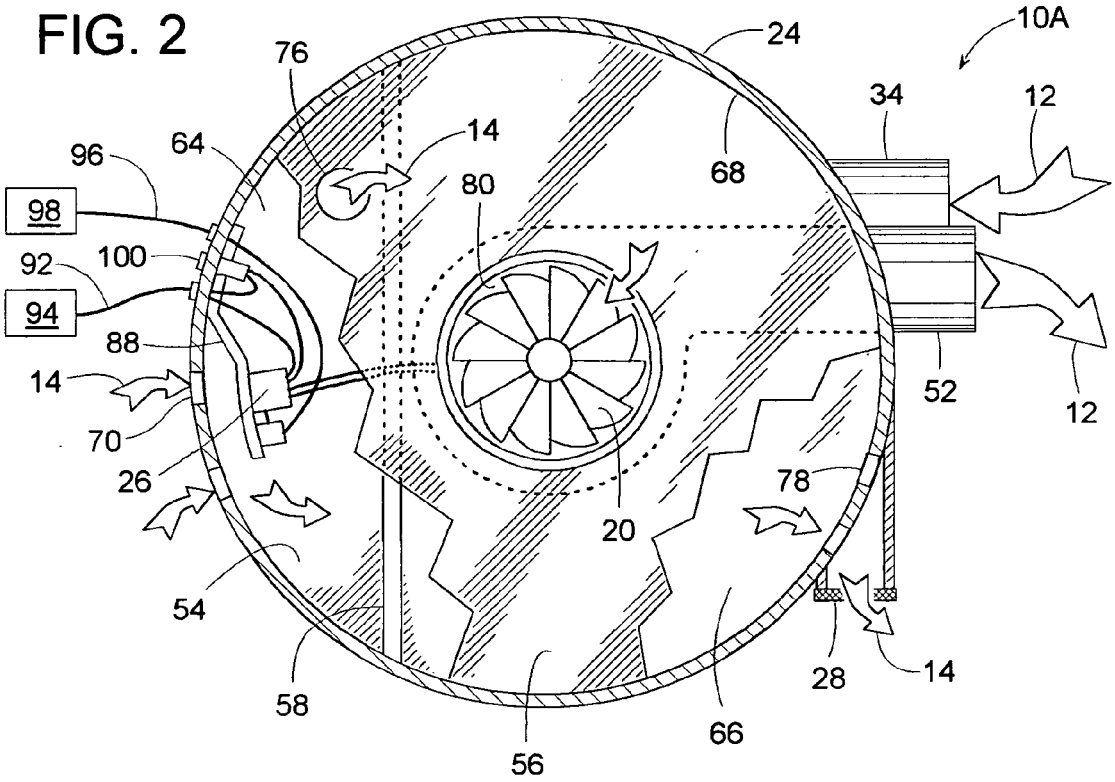
FIG. 2 a cross-sectional view taken generally along line 2-2 of FIG. 1, wherein portions of a canister divider system are cutaway to show underlying detail. Also, vent holes are shown elevated from their true position to more clearly show their function.

FIGS. 1 and 2 show a vacuum system 10 that conveys primary air 12 for cleaning (larger arrows) and conveys secondary air 14 for cooling (smaller arrows). A motor 16 drives both a main impeller 18 for moving primary air 12 and a fan or secondary impeller 20 for moving cooling air 14. A divider system 22 installed within a cylindrical or otherwise tubular canister 24 divides the canister into various chambers and directs secondary air 14 in a flow pattern suitable for cooling motor 16 and for cooling at least one motor drive component 26 (e.g., triac). The flow pattern is such that air 14 provides ample cooling even though the airflow is partially restricted by a secondary filter 28 that captures carbon dust emitted from the motor's commutator brushes 30.

In operation, main impeller 18 draws air 12 from within a suction chamber 32 of canister 24, which is installed at a generally fixed location. A suction inlet 34 connects suction chamber 32 to a network of tubing 36 that leads to several wall-mounted inlet ports 38 that are installed at various locations throughout a house or building 40. A flexible hose 42 connects a portable vacuum tool 44 to any of the inlet ports 38 so that tool 44 can be used for vacuuming a floor 46 or other surfaces.

To clean a surface, motor-driven impeller 18 draws dust-laden air or some other fluid from ambient atmosphere 86 in series through tool 44, through hose 42, through tubing network 36, through suction inlet 34, and into suction chamber 32 where much of the dust and other contaminants collects within a filter bag or accumulates at the bottom of canister 24. A main separator 48 installed between suction inlet 34 and main impeller 18 helps trap the contaminants within canister 24. Although separator 48 is shown as a dust-collecting filter bag, other separator designs are well within the scope of the invention. A joint connector 50 enables canister 24 to be manually opened to change or clean separator 48 or to empty the canister periodically. In this example, the dust and air are separated by filtration and the dust is collected within a filter bag; however, other methods of separation and collection can be used.

After separating the dust from the air, main impeller 18 discharges cleaner air through a discharge outlet 52 that exhausts the air to ambient atmosphere 86. The term, "ambient atmosphere" refers to any gas or other fluid outside canister 24. Examples of ambient atmosphere include, but are not limited to, the air surrounding the canister's exterior, the air just upstream of suction inlet 34, and the air within building 40.

In some embodiments, in order to cool motor 16 and one or more of its drive components 26, divider system 22 comprises a first divider 54, a second divider 56 and a third divider 58. First and second dividers 54 and 56 are generally round and extend diametrically across canister 24 to help define a plenum 60 at the upper end of canister 24, suction chamber 32 at the bottom, and a heat-generating chamber 62 between chambers 32 and 60. Third divider 58 extends between dividers 54 and 56 to separate heat-generating chamber 62 into an electrical chamber 64 and a motor chamber 66. Motor 16 extends into motor chamber 66, and one or more motor drive components 26 are disposed within electrical chamber 64.

The term, "motor drive component" refers to any heat-generating electrical device that affects the motor's electrical power. Examples of a motor drive component include, but are not limited to, a triac, diac, power transistor, resistor, inverter, etc. Many such motor drive components are particularly suited for central vacuum systems where a variable speed motor drive is important for switching between heavy and light duty vacuuming (e.g., vacuuming floors vs. curtains).

To provide a path for cooling air 14 to circulate through electrical chamber 64, motor chamber 66 and plenum 60, a tubular sidewall 68 of canister 24 defines one or more electrical chamber inlets 70, an upper end cap 72 defines a plenum inlet 74, and second divider 56 defines an opening or electrical chamber outlet 76. Tubular sidewall 68 also defines one or more motor chamber outlets 78 that lead to secondary filter 28. In cases where third divider 58 is omitted, motor chamber outlet 78 can be referred to as a heat-generating chamber outlet because the heat-generating chamber would no longer be divided into two distinct chambers (i.e., no longer a motor chamber and an electrical chamber).

To cool motor 16 and component 26, and to inhibit carbon dust from being discharged to atmosphere, secondary impeller 20 draws air 14 from plenum 60, through a secondary impeller inlet 80, and into motor chamber 66. Impeller 20 forces air 14 across motor 16 where some of air 14 passes between the motor's stator 82 and rotor 84 and other portions of air 14 pass out over the top of stator 82 near the motor's commutator brushes 30. After cooling motor 16, air 14 travels from motor chamber 66, through motor chamber outlet 78, through secondary filter 28, and out to ambient atmosphere 86. Secondary filter 28 helps capture airborne carbon dust to ensure that air 14 being exhausted to atmosphere is sufficiently clean.

To supply plenum 60 with air, impeller 20 creates a negative pressure (below atmospheric pressure) within plenum 60, which draws ambient air into plenum 60 through plenum inlet 74. Electrical chamber outlet 76 allows the negative pressure in plenum 60 to also draw in 14 air that has been preheated by component 26 in electrical chamber 64. Thus, plenum 60 receives a mixture of ambient air and preheated air, wherein secondary impeller inlet 80 delivers the mixture to motor chamber 66.

To cool motor drive component 26, the air entering plenum 60 through electrical chamber outlet 76 reduces the pressure within electrical chamber 64 such that ambient air is drawn into chamber 64 via electrical chamber inlet 70. Thus, air 14 travels in series through electrical chamber inlet 70, through electrical chamber 64 to cool component 26, and out through electrical chamber outlet 76 to mix with ambient air in plenum 60. A bracket 88 attached to sidewall 68 supports motor drive component 26 at a position where air 14 entering through electrical chamber inlet 70 can pass directly across and around component 26.

The flow of air 14 through the upper portion of canister 24 is such that the motor chamber pressure is greater than the ambient atmosphere pressure, the ambient atmosphere pressure is greater than the electrical chamber pressure, the electrical chamber pressure is greater than the plenum pressure, and the plenum pressure is greater than the suction pressure in suction chamber 32. The term, "pressure" pertains to absolute pressure rather than gage pressure, thus even air below atmospheric pressure (e.g., below 14.7 psi) can be considered to have a positive absolute pressure.

The electrical chamber inlet 70 enables component 26 to be cooled by relatively cool ambient air that is generally not preheated by motor 16. Also, the influx of ambient air through plenum inlet 74 allows motor 16 to receive at least some fresh air that has not first passed across component 26. Moreover, component 26 being upstream of motor 16 helps prevent the motor brush's carbon dust from contaminating component 26 or its associated circuit board.

Since electrical chamber 64 receives unheated ambient air through electrical chamber inlet 70, and motor 16 receives a slightly warmer mixture of air, it may be desirable to have the flow rate of air 14 passing through motor chamber 66 be slightly greater than that passing through electrical chamber 64, which in fact is the case with vacuum system 10.

By locating electrical chamber 64 along the side of canister 24, upper end cap 72 can be removed via a joint 90 without disturbing any electrical connections that feed into canister 24. Examples of such electrical connections include, but are not limited to, a power cord 92 from a power supply 94 (e.g., wall outlet), control-wiring 96 from a control panel 98, a fuse 100, etc. In a currently preferred embodiment, the electrical connections are supported by the same bracket 88 that supports motor drive component 26.

Figure 3:
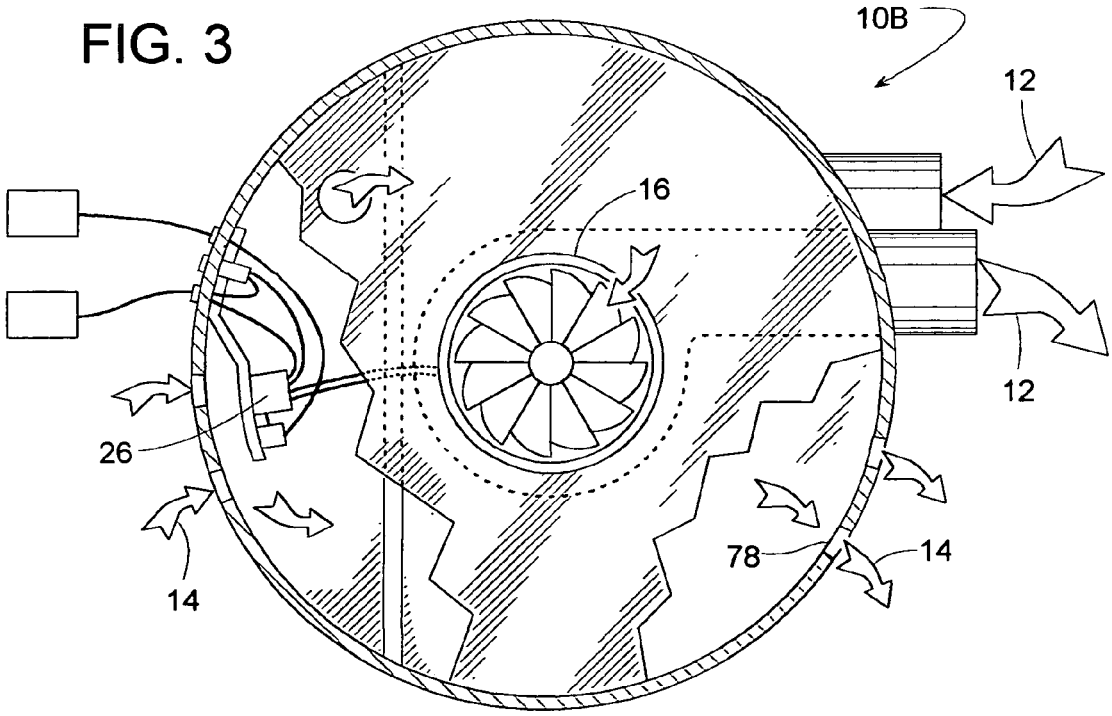
FIG. 3 is similar to FIG. 2 but showing a different embodiment where the carbon dust filter is omitted.

In another embodiment, shown in FIG. 3, a vacuum system 10*b* is the same as vacuum system 10*a*; however, secondary filter 28 is omitted. Without filter 28, motor chamber outlet 78 exhausts unfiltered air 14 directly to atmosphere. Although carbon dust may be released, removing filter 28 may increase the cooling of motor 16 and component 26.

Figure 4:
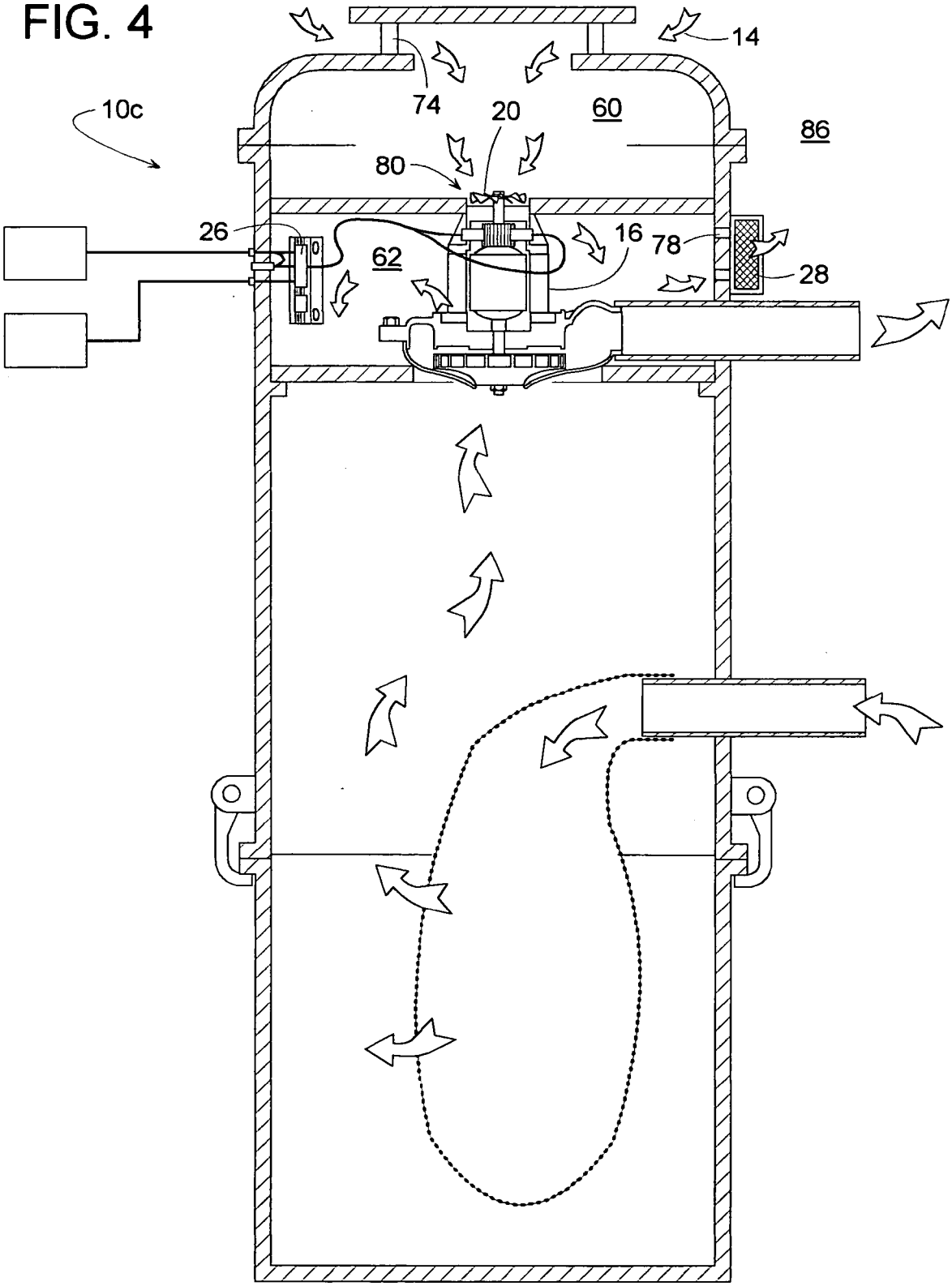
FIG. 4 is similar to FIG. 1 but showing one of the dividers omitted.

In another embodiment, shown in FIG. 4, a vacuum system 10*c* is similar to vacuum system 10*a*; however, third divider 58, electrical chamber inlet 70 and electrical chamber outlet 76 are omitted. Without third divider 58, motor 16 and drive component 26 share the same space within heat-generating chamber 62. In this case, secondary impeller 20 forces cooling air 14 to travel in series from ambient atmosphere 86, through plenum inlet 74, through plenum 60, through secondary impeller inlet 80, into heat-generating chamber 62 to cool motor 16 and component 26, through heat-generating chamber outlet 78, through secondary filter 28 to impede carbon dust, and back out to ambient atmosphere 86.

Figure 5:
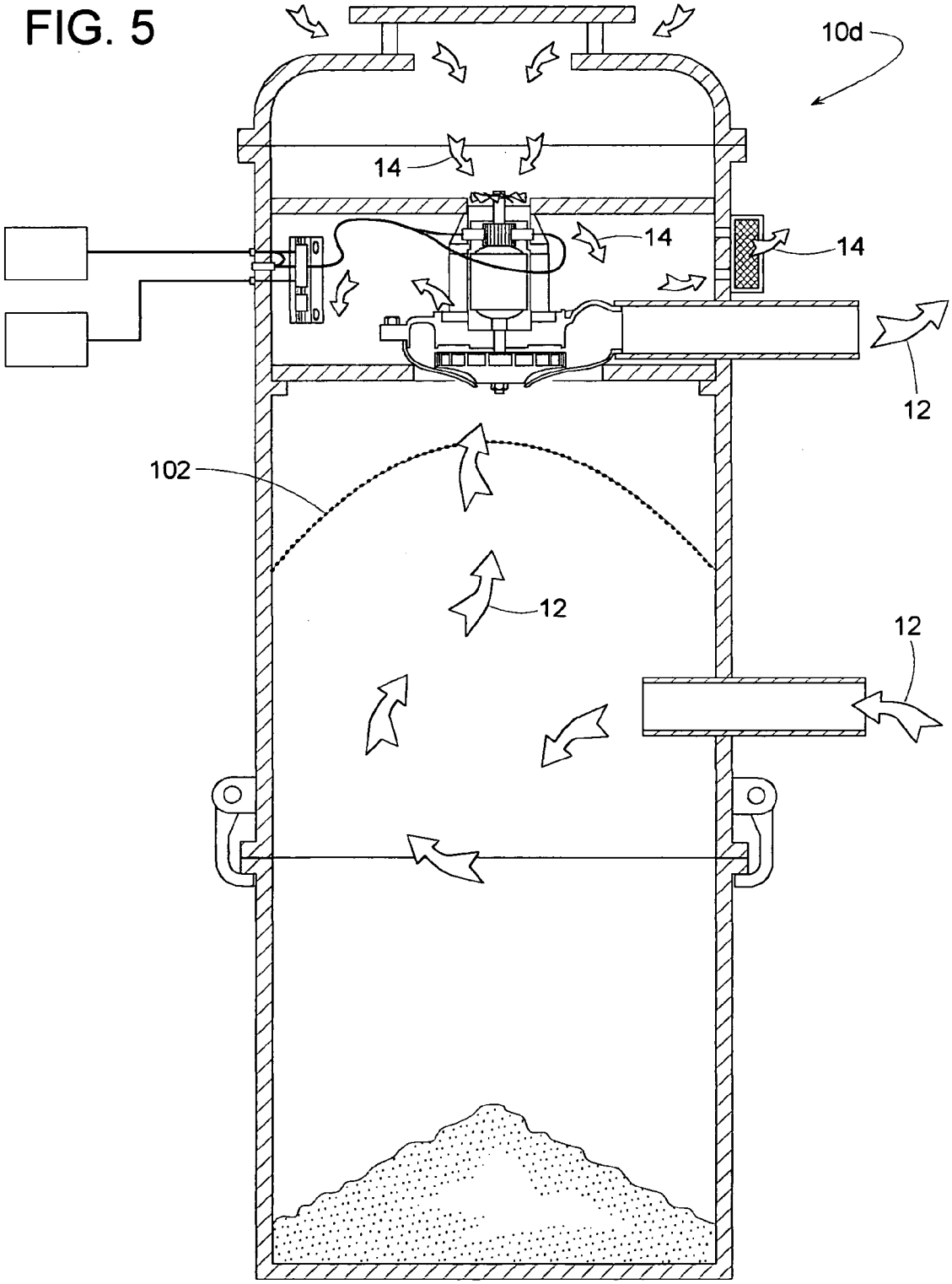
FIG. 5 is similar to FIG. 4 but showing a vacuum system that includes a different type of main filter.

In another embodiment, shown in FIG. 5, a vacuum system 10*d* is the same as vacuum system 10*c*; however, main separator 48 (in the form of a bag) is replaced by another main filter 102 of a different shape. With filter 102, dust collects at the bottom of the vacuum canister.

Figure 6:
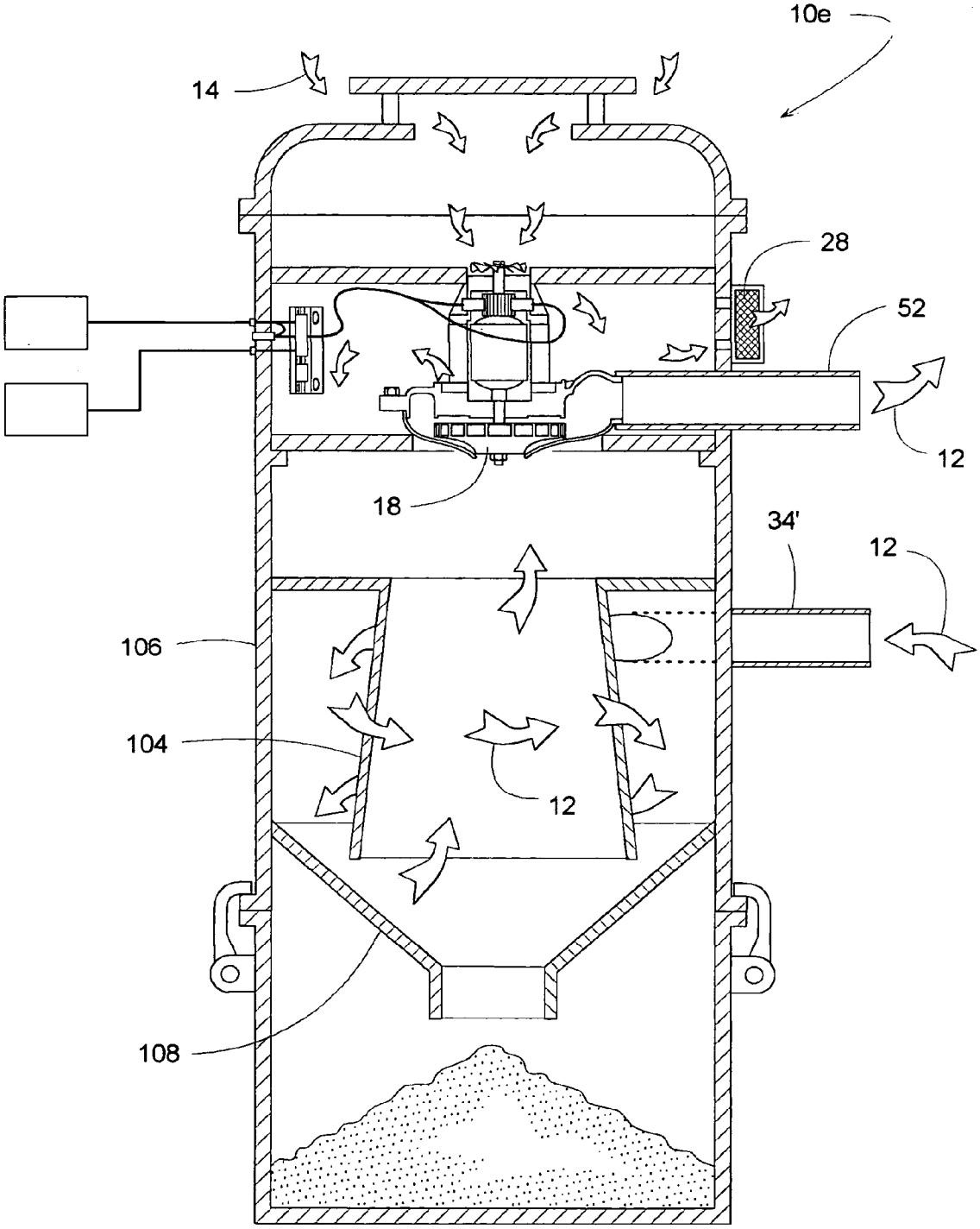
FIG. 6 is a cross-sectional view similar to FIG. 5 but showing yet another embodiment.

In another embodiment, shown in FIG. 6, a vacuum system 10*e* is similar to systems 10*c* and 10*d*; however vacuum system 10*e* separates contaminants from air 12 using a separator in the form of a vortex-generating cylinder 104 installed within a cylindrical canister 106. A suction inlet 34' leading tangentially into canister 106 directs air 12 into a downward circular motion around cylinder 104. Centrifugal force separates the contaminants from air 12 by slinging the heavier contaminating particles and against the interior wall of canister 106. A funnel 108 then directs the separated contaminants to the bottom of canister 106 for later disposal. Once the contaminants are separated from the air, the cleaner air travels up through a central portion of cylinder 104. From there, impeller 18 forces the now cleaner air out through discharge outlet 52.

Although the invention is described with reference to a preferred embodiment, it should be appreciated by those of ordinary skill in the art that various modifications are well within the scope of the invention. The separators of FIGS. 5 and 6, for example, can also be used in the vacuum systems illustrated in FIG. 1. Therefore, the scope of the invention is to be determined by reference to the following claims.

The invention claimed is:

1. A central vacuum system for reducing the pressure of air to less than that of an ambient atmosphere that contains contaminants, the system comprising:

a canister for installation at a substantially fixed location;

a divider system disposed within the canister to help define within the canister a suction chamber, a motor chamber, a plenum, and an electrical chamber;

a motor extending into the motor chamber, wherein the motor heats the air therein;

a main impeller coupled to the motor to help create a suction pressure within the suction chamber;

a secondary impeller coupled to the motor, wherein the secondary impeller forces air from the ambient atmosphere into the electrical chamber, forces air from the electrical chamber into the plenum, forces air from the plenum into the motor chamber, and forces air from the motor chamber to the ambient atmosphere; and a motor drive component disposed within the electrical chamber and being electrically coupled to the motor, wherein the air forced through the electrical chamber helps cool the motor drive component.

2. The central vacuum system of claim 1, wherein the air in the electrical chamber is upstream of the air in the motor chamber.

3. The central vacuum system of claim 1, wherein the motor chamber conveys air at a greater flow rate than that of the electrical chamber.

4. The central vacuum system of claim 1, wherein the air in the plenum is cooler than the air in the electrical chamber.

5. The central vacuum system of claim 1, wherein the electrical chamber conveys air at an electrical chamber pressure, the plenum conveys air at a plenum pressure, the motor chamber conveys air at a motor chamber pressure, and the suction chamber conveys air at a suction pressure, wherein:

i. the motor chamber pressure is greater than the ambient atmosphere pressure, ii. the ambient atmosphere pressure is greater than the electrical chamber pressure, iii. the electrical chamber pressure is greater than the plenum pressure, and iv. the plenum pressure is greater than the suction pressure.

6. The central vacuum system of claim 1, wherein the plenum is above the electrical chamber and the motor chamber, and the suction chamber is below the electrical chamber and the motor chamber.

7. The central vacuum system of claim 1, wherein the canister comprises a substantially cylindrical outer wall within which the electrical chamber is contained.

8. The central vacuum system of claim 7, wherein the weight of the electrical component is carried by the substantially cylindrical outer wall.

9. The central vacuum system of claim 1, wherein the divider system includes a first divider and a second divider, wherein the first divider separates the motor chamber from the suction chamber, and the second divider separates the plenum from the motor chamber, and the second divider defines an opening that places the plenum in fluid communication with the electrical chamber.

10. The central vacuum system of claim 9, wherein the divider system includes a third divider extending between the first divider and the second divider.

11. The central vacuum system of claim 1, further comprising:

a main separator interposed between the main impeller and the suction chamber to help separate the contaminants from the air that the main impeller draws from the suction chamber; and a secondary filter interposed between the motor chamber and the ambient atmosphere, wherein the secondary filter helps filter the air passing from the motor chamber to the ambient atmosphere.

12. A central vacuum system for reducing the pressure of air to less than that of an ambient atmosphere that contains contaminants, the system comprising:

a canister that includes a tubular sidewall and an upper end cap, wherein the upper end cap defines a plenum inlet, and the tubular sidewall defines a suction inlet, an electrical chamber inlet and a motor chamber outlet;

a first divider disposed within the canister, wherein the first divider and the tubular sidewall help define a suction chamber that is in fluid communication with the ambient atmosphere via the suction inlet;

a second divider disposed within the canister and defining an electrical chamber outlet, wherein the second divider, the tubular sidewall and the upper end cap help define a plenum that is in fluid communication with the ambient atmosphere via the plenum inlet;

a third divider disposed within the canister and extending between the first divider and the second divider, wherein first divider, the second divider, the third divider and the sidewall help define a motor chamber and an electrical chamber, wherein the motor chamber is in fluid communication with the ambient atmosphere via the motor chamber outlet, the motor chamber is in fluid communication with the plenum, and the electrical chamber is in fluid communication with the ambient atmosphere via the electrical chamber inlet;

a motor extending into the motor chamber, wherein the motor heats the air therein;

a main impeller coupled to the motor to help create a suction pressure within the suction chamber;

a motor drive component disposed within the electrical chamber and being electrically coupled to the motor, wherein the motor drive component heats the air within the electrical chamber; and a secondary impeller coupled to the motor, wherein the secondary impeller:

i. forces air from the ambient atmosphere into the electrical chamber via the electrical chamber inlet, ii. forces air from the electrical chamber into the plenum via the electrical chamber outlet, iii. forces air from the ambient atmosphere into the plenum via the plenum inlet, iv. forces air from the plenum into the motor chamber, and v. forces air from the motor chamber to the ambient atmosphere via the motor chamber outlet.

13. The central vacuum system of claim 12, wherein the motor chamber conveys air at a greater flow rate than that of the electrical chamber.

14. The central vacuum system of claim 12, wherein the air in the plenum is cooler than the air in the electrical chamber.

15. The central vacuum system of claim 12, wherein the electrical chamber conveys air at an electrical chamber pressure, the plenum conveys air at a plenum pressure, the motor chamber conveys air at a motor chamber pressure, and the suction chamber conveys air at a suction pressure, wherein:

i. the motor chamber pressure is greater than the ambient atmosphere pressure, ii. the ambient atmosphere pressure is greater than the electrical chamber pressure, iii. the electrical chamber pressure is greater than the plenum pressure, and iv. the plenum pressure is greater than the suction pressure.

16. The central vacuum system of claim 12, wherein the plenum is above the electrical chamber and the motor chamber, and the suction chamber is below the electrical chamber and the motor chamber.

17. The central vacuum system of claim 12, further comprising:

a main separator interposed between the main impeller and the suction chamber to help separate the contaminants from the air that the main impeller draws from the suction chamber; and a secondary filter interposed between the motor chamber and the ambient atmosphere, wherein the secondary filter helps filter the air passing from the motor chamber to the ambient atmosphere.

* * * * *